US005511618A

United States Patent [19]

Budde

[11] Patent Number: 5,511,618

[45] Date of Patent: Apr. 30, 1996

[54] FILL VALVE

[75] Inventor: Peter Budde, Chevreuse, France

[73] Assignee: Weatherford/Lamb, Inc., Houston, Tex.

[21] Appl. No.: 519,503

[22] Filed: Aug. 25, 1995

Related U.S. Application Data

[63] Continuation of Ser. No. 283,404, Aug. 1, 1994, Pat. No. 5,450,903.

[30] Foreign Application Priority Data

Mar. 22, 1994 [GB] United Kingdom ..... 9405679

[51] Int. Cl.[6] ..... E21B 34/10

[52] U.S. Cl. ..... 166/321; 166/327

[58] Field of Search ..... 166/319, 321, 166/322, 325, 327

[56] References Cited

U.S. PATENT DOCUMENTS

| | | | |
|---|---|---|---|
| 2,748,873 | 6/1956 | Baker et al. | 166/327 X |
| 3,273,650 | 9/1966 | Alexander et al. | 166/327 X |
| 3,967,680 | 7/1976 | Jeter | 166/325 X |
| 4,625,755 | 12/1986 | Reddoch | 166/325 X |
| 4,955,949 | 9/1990 | Bailey et al. | 166/325 X |
| 4,962,819 | 10/1990 | Bailey et al. | 166/325 X |
| 5,450,903 | 9/1995 | Budde | 166/321 |

*Primary Examiner*—Roger J. Schoeppel
*Attorney, Agent, or Firm*—Guy McClung

[57] ABSTRACT

A fill valve includes a tubular housing which accommodates a valve member which is biased toward a closed position by a light spring. The valve member includes a head and a tubular portion which is provided with two large windows. When the fill valve is open fluid flows freely through the tubular portion of the fill valve and out of the windows.

16 Claims, 8 Drawing Sheets

FILL VALVE

This is continuation of application Ser. No. 08/283,404, filed on Aug. 1, 1994, now U.S. Pat. No. 5,450,903.

BACKGROUND OF THE INVENTION

This invention relates to a fill valve for use in the construction of oil and gas wells.

FIELD OF THE INVENTION

During the construction of oil and gas wells a borehole is drilled to a certain depth. The drill string is then removed and casing inserted. The annular space between the outside of the casing and the wall of the borehole is then conditioned for cementing by pumping conditioning fluid down the casing. The conditioning fluid flows radially outwardly from the bottom of the casing and passes-upwardly through the annular space where it entrains debris and carries it to the surface. Finally, cement is pumped downwardly through the casing, squeezes radially outwardly from the bottom of the casing and passes upwardly into the annular space where is sets.

Conventionally a fill valve is fitted on the bottom of the casing or close to the bottom. The fill valve inhibits fluid entering the casing from the bore but permits fluid to flow from the casing into the borehole. The fill valve is normally incorporated in a float shoe or a float collar, a float shoe being fitted on the bottom of the casing whilst a float collar is incorporated between two lengths of casing.

At the present time certain of applicants' float valves comprises a tubular housing accommodating a valve member which is slidably mounted in the tubular housing. The valve member is generally mushroom shape having a head which is biased upwardly against a valve seat by a spring circumjacent the stem of the valve member. Whilst this arrangement works quite acceptably, the rate at which fluid, for example mud, conditioning fluid and cement, can flow through the flow valve is limited by the relatively small flow area between the radial circumference of the head of the valve member and the inside of the tubular housing.

The object of at least preferred embodiments of the present invention is to provide a fill valve which, when open, will allow freer passage of fluids therethrough.

SUMMARY OF THE INVENTION

According to the present invention there is provided a fill valve comprising a tubular housing accommodating a valve member which is biased towards a closed position, characterized in that said valve member comprises a head, a tubular portion and at least one window in said tubular portion, the arrangement being such that, in use, when said fill valve is open, fluid can flow from a casing, through said tubular portion and exit via said at least one window.

Preferably, said tubular portion has at least two windows disposed in the periphery of said tubular portion.

Advantageously, said valve member is provided with a deflector for deflecting fluid entering said tubular portion towards said at least one window.

Preferably, said deflector is designed to inhibit turbulence in the fluid as it passes through the fill valve.

In a particularly preferred embodiment said tubular portion is provided with two windows which are disposed opposite one another and said deflector extends from said head into said tubular portion.

In one embodiment, the head is arranged to seat on the bottom of the tubular housing. In another embodiment the head has a bevelled surface adapted to seat on a correspondingly bevelled valve seat in the tubular housing, optionally with the assistance of a sealing ring.

Conveniently, a coil spring is used to bias the valve member to a closed position. The coil spring may be mounted circumjacent the tubular portion of the valve member and arranged to act between a flange on the tubular portion of the valve member and a shoulder formed in the tubular housing.

If desired the fill valve may include an attachment connected to said valve member, said attachment being adjustable to maintain said fill valve in a partially open position.

Preferably, said attachment comprises a spider having at least one leg which radiates outwardly from a hub, and a member which extends through said hub and engages said valve member, the arrangement being such that the opening of said fill valve may be adjusted by rotation of said member.

The present invention also provides a float collar provided with a fill valve in accordance with the invention and a float shoe provided with a fill valve in accordance with the invention.

For a better understanding of the present invention reference will now be made, by way of example, to the accompanying drawings, in which:

DETAILED DESCRIPTION OF THE PREFERRED EMBODIMENTS

Figure 1:
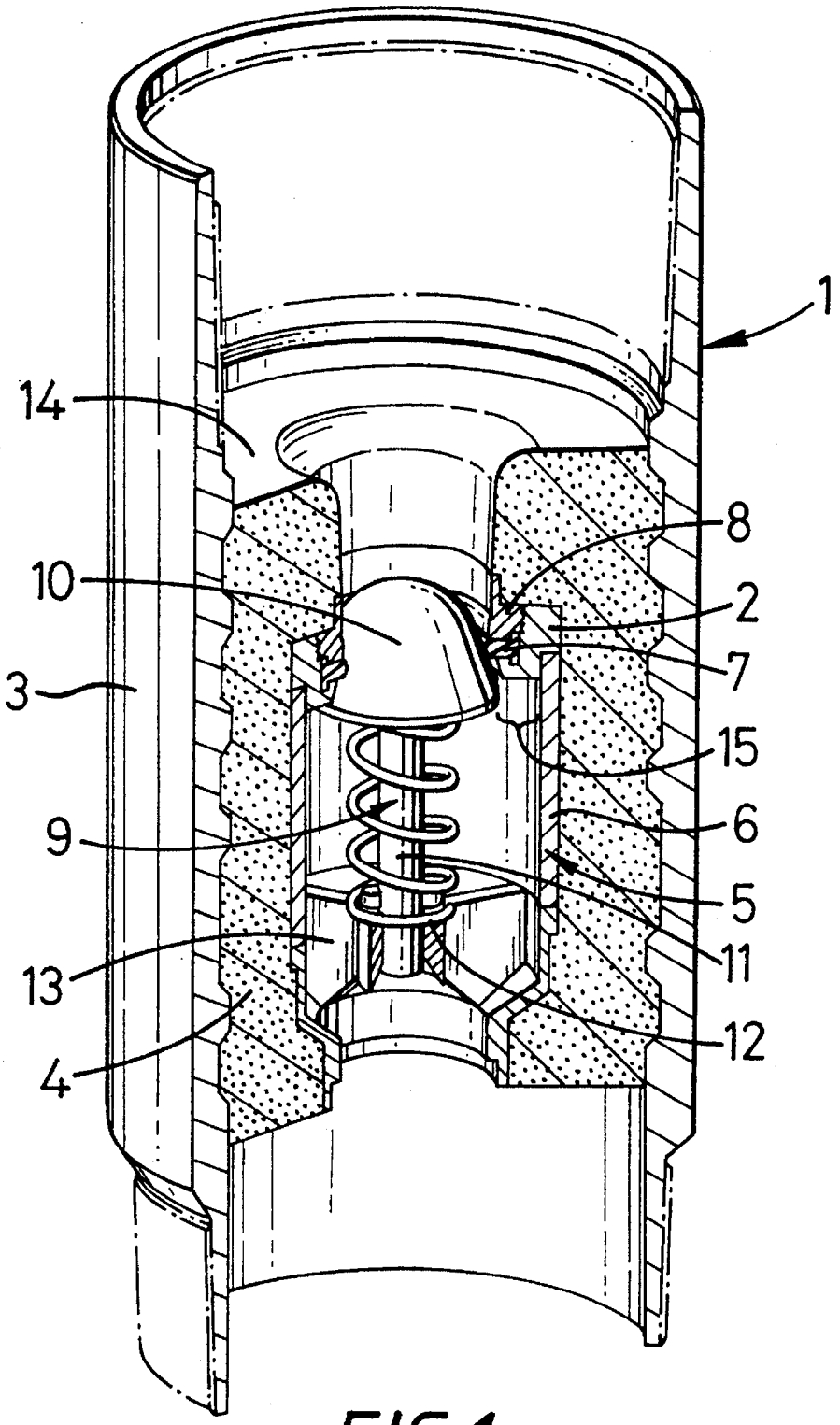
FIG. 1 is a sectional view of one of the applicants float collars incorporating a known fill valve.

Referring to FIG. 1 of the drawings, there is shown one of applicants current float collars which is generally identified by reference numeral 1.

The float collar 1 comprises a fill valve 2 which is mounted in a short length of casing 3 by fan annulus of high density cement 4.

The fill valve 2 comprises a tubular housing 5 including a cylindrical portion 6 and a valve seat 7 supported by a plate 8.

A valve member 9 is accommodated in the tubular housing 5. The valve member 9 is mushroom shaped and comprises a head 10 and a stem 11.

The head 10 is biased against the valve seat 7 by a light spring 12 which is disposed circumjacent the stem 11 and acts between the head 10 and a spider 13.

In use, the float collar 1 is mounted in a length of casing towards the bottom thereof. Once the casing is in position mud is pumped down the casing 3. The mud flows through the fill valve 2 and then passes radially outwardly from the bottom of the casing 3 and upwardly through an annulus between the casing 3 and the wellbore. The mud carries debris to the surface. Typically mud is passed through the fill valve 2 for several hours. Conditioning fluid (usually referred to as "spacer) is then pumped down the casing. The conditioning fluid helps remove the mud and contains chemicals which help the cement adhere to the casing.

After conditioning a charge of cement is pumped down the casing between a top plug and a bottom plug in the conventional manner. After the bottom plug seats on the upper surface 14 of the float collar 1 increasing pressure is applied to the top plug until a bursting disk in the bottom plug ruptures and permits the cement to flow downwardly into the float collar 1. The pressure applied to the cement by the top plug is transmitted to the head 10 of the valve member 9 which moves downwardly away from valve seat 7 thereby permitting the cement to pass through the fill valve 2.

When the top plug contacts the bottom plug no further cement passes through the fill valve. Pressure is then released on the top plug, the fill valve acting to inhibit cement flowing upwardly inside the casing. After the cement has set the top plug, bottom plug, fill valve and any cement below the fill valve are drilled out.

The flow of conditioning fluid and cement through the fill valve 2 is limited by the flow area between the perimeter of the head 10 of the valve member 9 and the cylindrical portion 6 of the tubular housing 5, i.e the annulus having the width 15.

Figure 2:
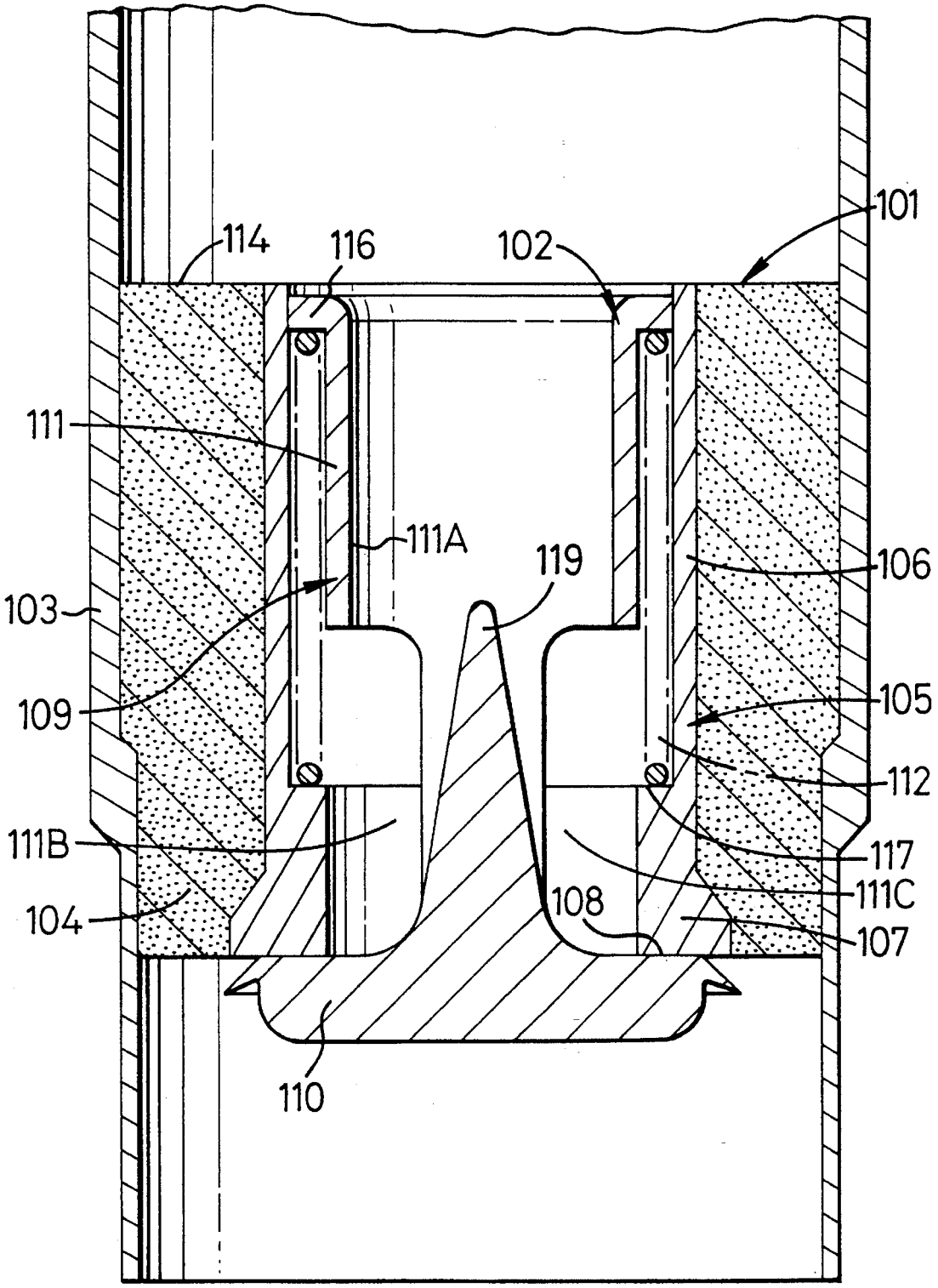
FIG. 2 is a cross-sectional view of one embodiment of a float collar incorporating a fill valve in accordance with the present invention in its closed position.
Figure 3:
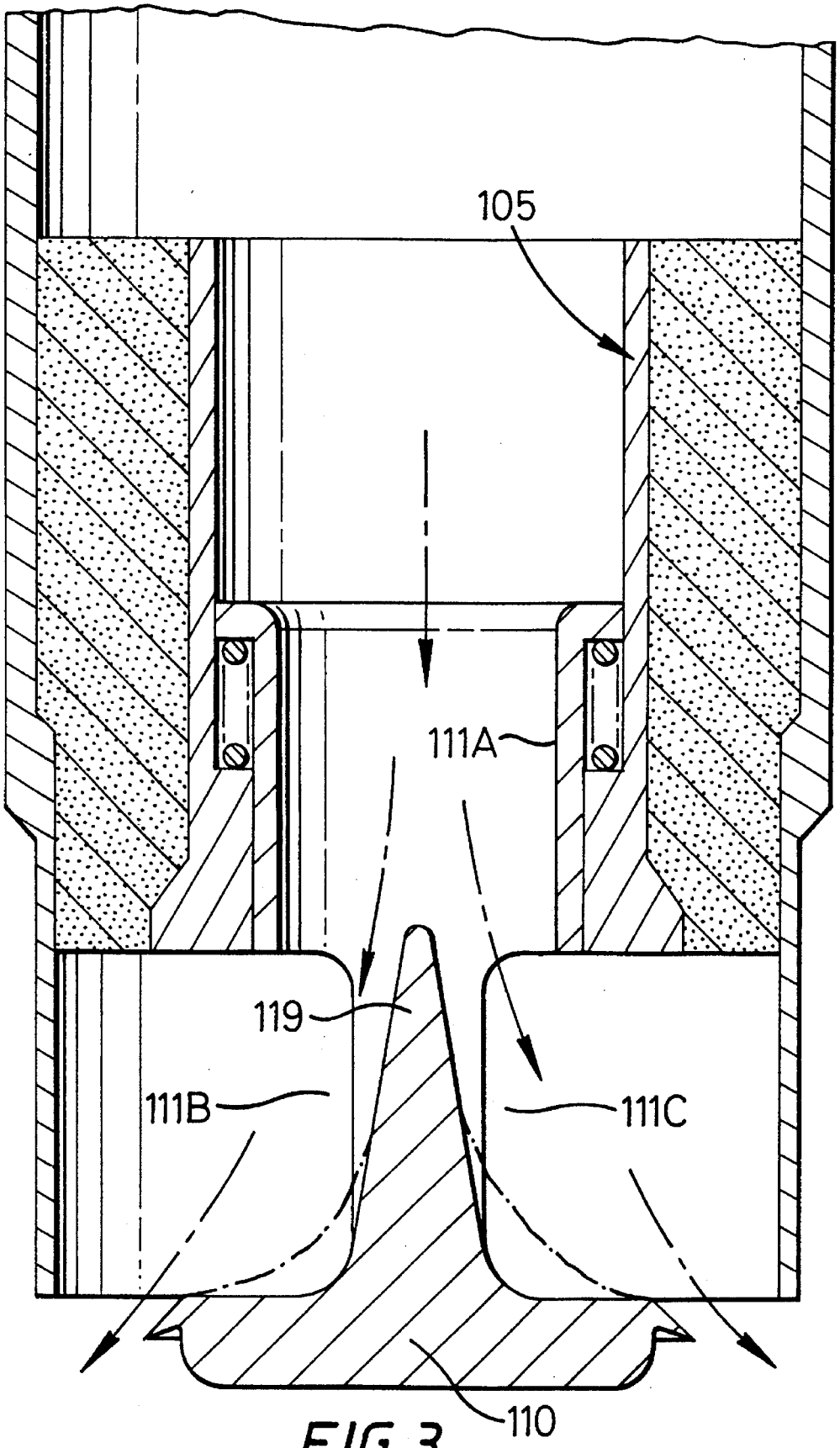
FIG. 3 is a view similar to FIG. 2 but showing the fill valve in its open position.

Referring now to FIGS. 2 and 3 of the drawings there is shown a float collar which is generally identified by reference number 101.

The float collar 101 comprises a fill valve 102 which is mounted in a short length of casing 103 by an annulus of high density cement 104.

The fill valve 102 comprises a tubular housing 105 including a cylindrical portion 106 and a valve seat 107 having a seating surface 108.

A valve member 109 is accommodated in the tubular housing 105. The valve member comprises a head 110 and a stem 111 which comprises a tubular portion 111A provided with windows 111B and 111C.

The head 110 is biased against the valve seat 107 by a light spring 112 which is disposed circumjacent the stem 111 and acts between a flange 116 on the top of the tubular portion 111A and a shoulder 117 formed in the tubular housing 105 between the cylindrical portion 106 and the valve seat 107.

In use the float collar 101 is mounted in a length of casing towards the bottom thereof. Once the casing is in position mud is pumped down the casing. The mud displaces the valve member 109 downwardly from valve seat 107 thereby permitting the mud to pass through the fill valve 102. The mud then passes downwardly to the bottom of the casing, radially outwardly and then upwardly in the annular space between the casing and the wellbore. The mud removes debris from the annular space and carries it to the surface. After several hours the flow of mud is stopped and conditioning fluid is pumped down the casing to prepare the annulus for cementing.

After conditioning a charge of cement is pumped down the casing between a top plug and a bottom plug in the conventional manner. After the bottom plug seats on the upper surface 114 of the float collar 101 increasing pressure is applied to the top plug until a bursting disk in the bottom plug ruptures and permits the cement to flow downwardly into the float collar 101. The pressure applied to the cement by the top plug is transmitted to the head 110 of the valve member 109 which moves downwardly away from valve seat 107 thereby permitting the cement to pass through the fill valve 102.

As shown in FIG. 3 the cement passed through the tubular portion 111A and exits via windows 111B and 111C which are disposed opposite one another.

A deflector 119 is provided and extends upwardly from the head 110 into the tubular portion 111A. The deflector 119 guides the cement towards the windows 111B and 111C.

In a prototype the fill valve 102 shown in FIGS. 2 and 3 had a flow area significantly greater than the fill valve 2 shown in FIG. 1 although the inner diameter of the cylindrical portions 6 and 106 of each fill valve 2, 102 was substantially equal.

Figure 4:
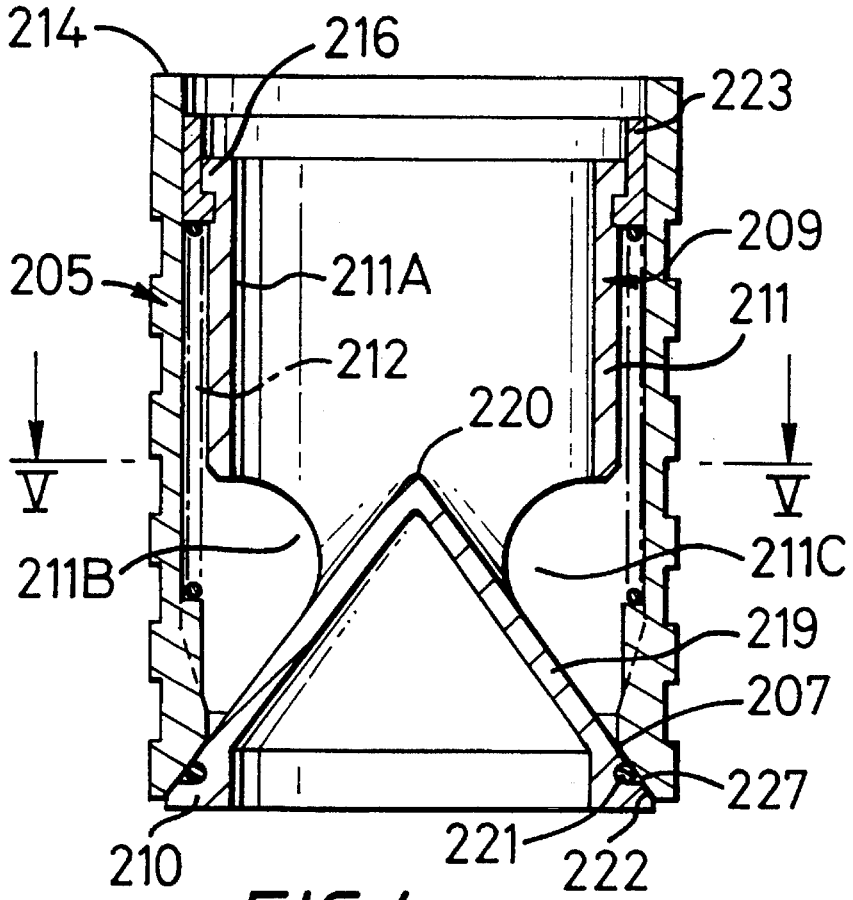
FIG. 4 is a sectional view of a second embodiment of a fill valve in accordance with the invention.
Figure 5:
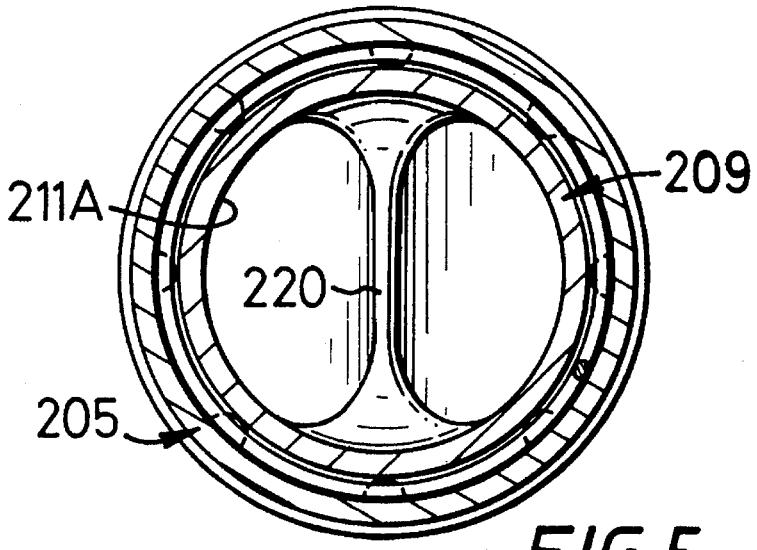
FIG. 5 is a view on line V—V of FIG. 4.

The embodiment show in FIGS. 4 and 5 is generally similar to that show in FIGS. 2 and 3 with the exception that the deflector 219 is inclined uniformly from the inside of the valve seat 207 to an apex 220 on the centreline of the valve member 209. In addition the valve seat 207 is bevelled and is arranged to receive an O-ring seal 221 mounted on a correspondingly bevelled surface 222 of the head 210 of the valve member 209. A further difference is that a ring 223 is attached to the stem 211. The ring 223 is recessed below the upper surface 214 of the float collar to ensure that valve member 209 does not start to open as soon as the bottom plug engages the upper surface 214 of the float collar. This arrangement also ensures that the stem 211 can rise freely at the end of cementation to close the fill valve.

Figure 6:
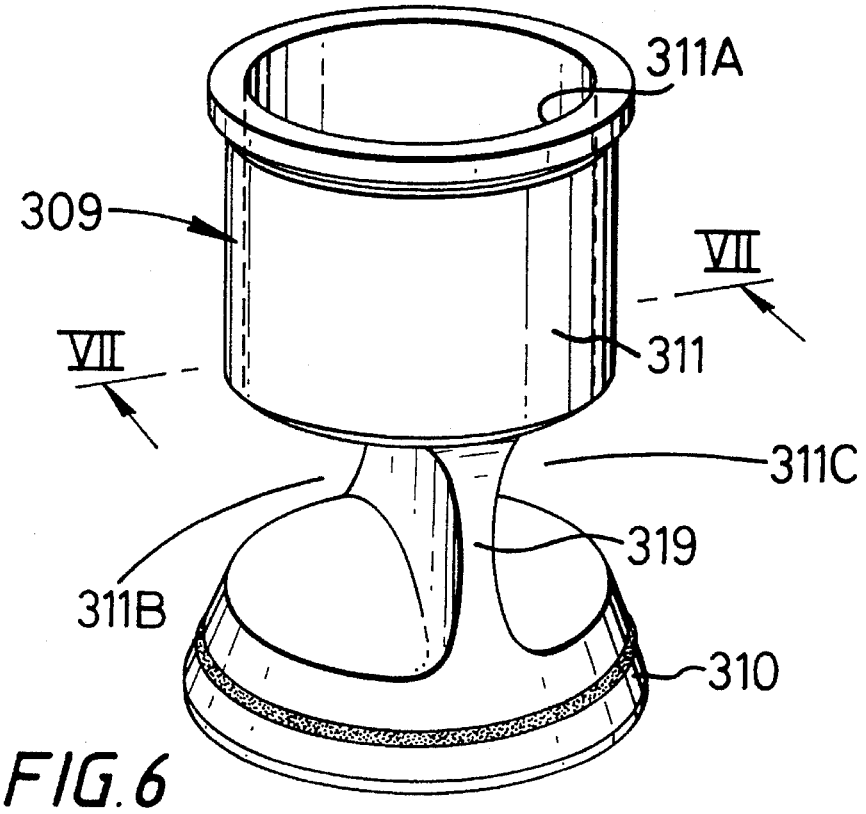
FIG. 6 is a perspective view of a valve member forming part of a third embodiment of a fill valve in accordance with the present invention.
Figure 7:
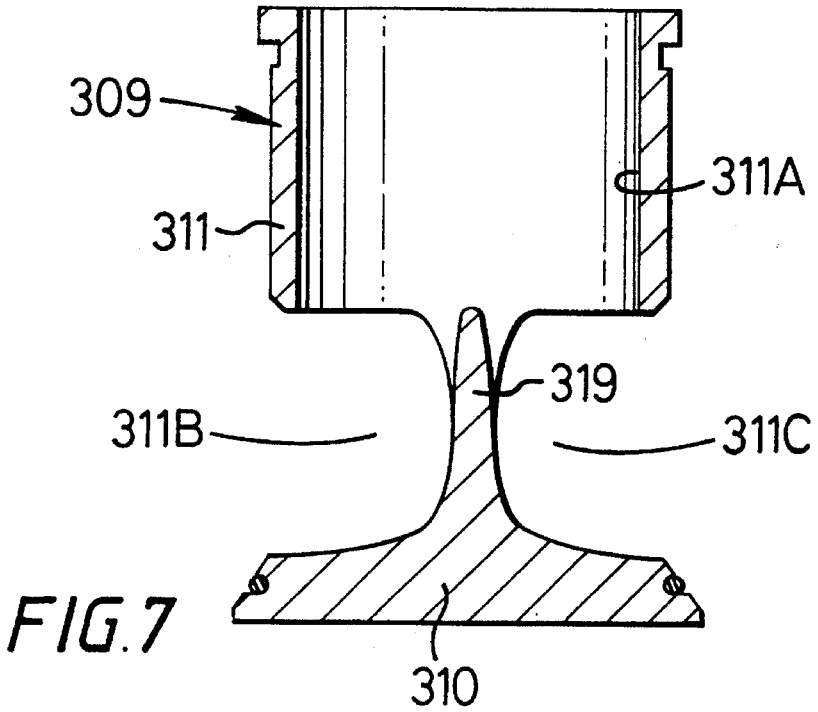
FIG. 7 is a view taken on line VII—VII of FIG. 6.

FIGS. 6 and 7 show a further embodiment using a relatively small deflector 319.

Figure 8:
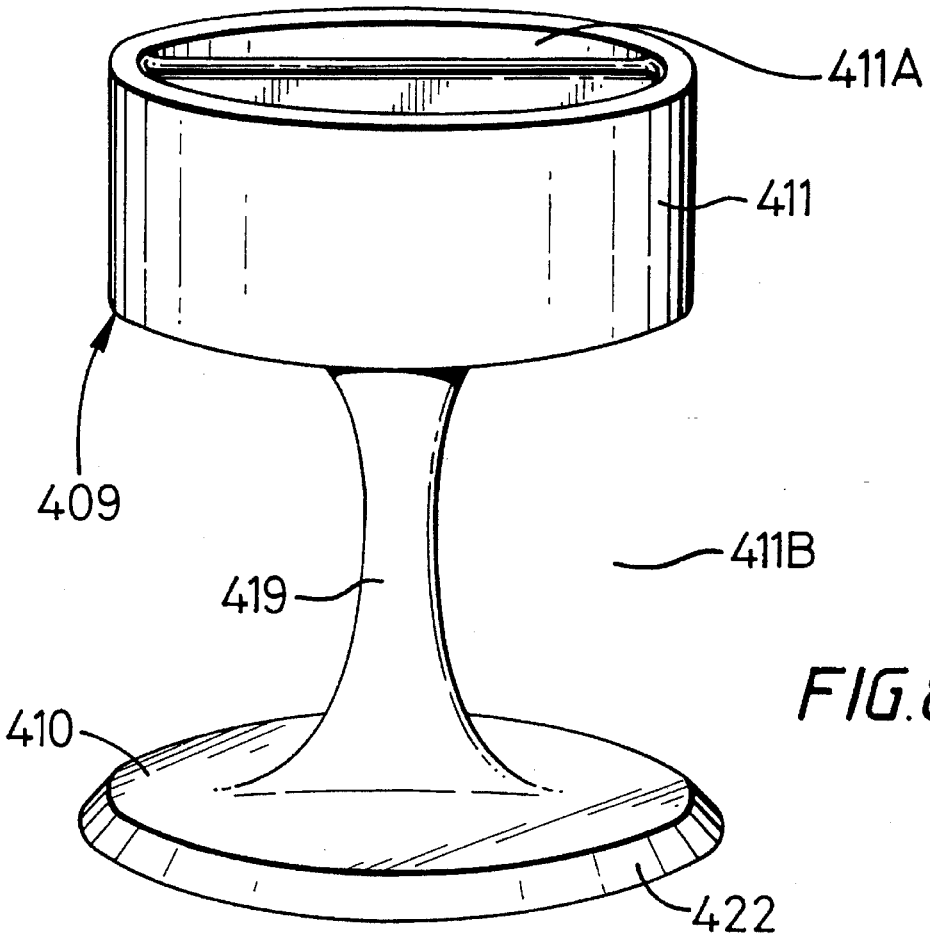
FIG. 8 is a perspective view of a valve member forming part of a fourth embodiment of a fill valve in accordance with the invention.
Figure 9:
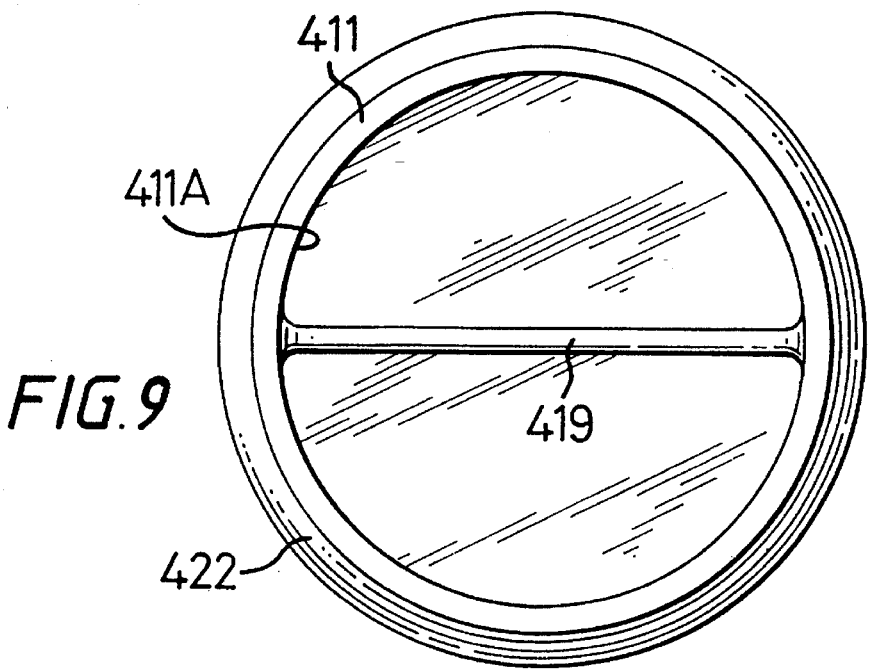
FIG. 9 is a top plan view of the valve member shown in FIG. 8.

FIGS. 8 and 9 show a valve member 409 which comprises a tubular portion 411A provided with a single window 411B. The head 410 has a bevelled surface 422 which, unlike the embodiment shown in FIGS. 4 and 5, is not provided with an O-ring seal. The head 410 is attached to the tubular portion 411A via deflector 419.

Figure 10:
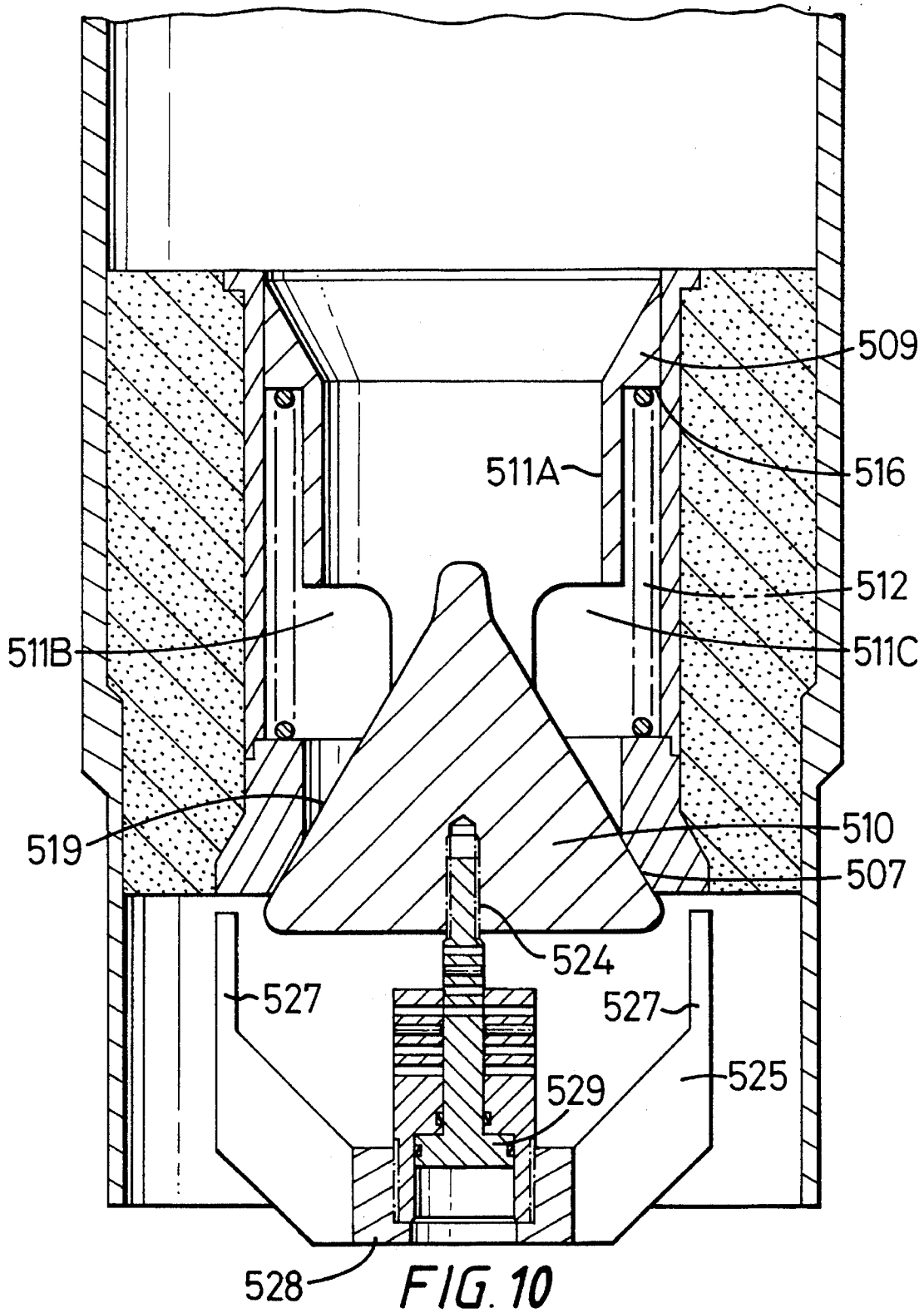
FIG. 10 is a vertical cross-section through a fifth embodiment of a fill value in accordance with the invention with an attachment in an inoperative position.
Figure 11:
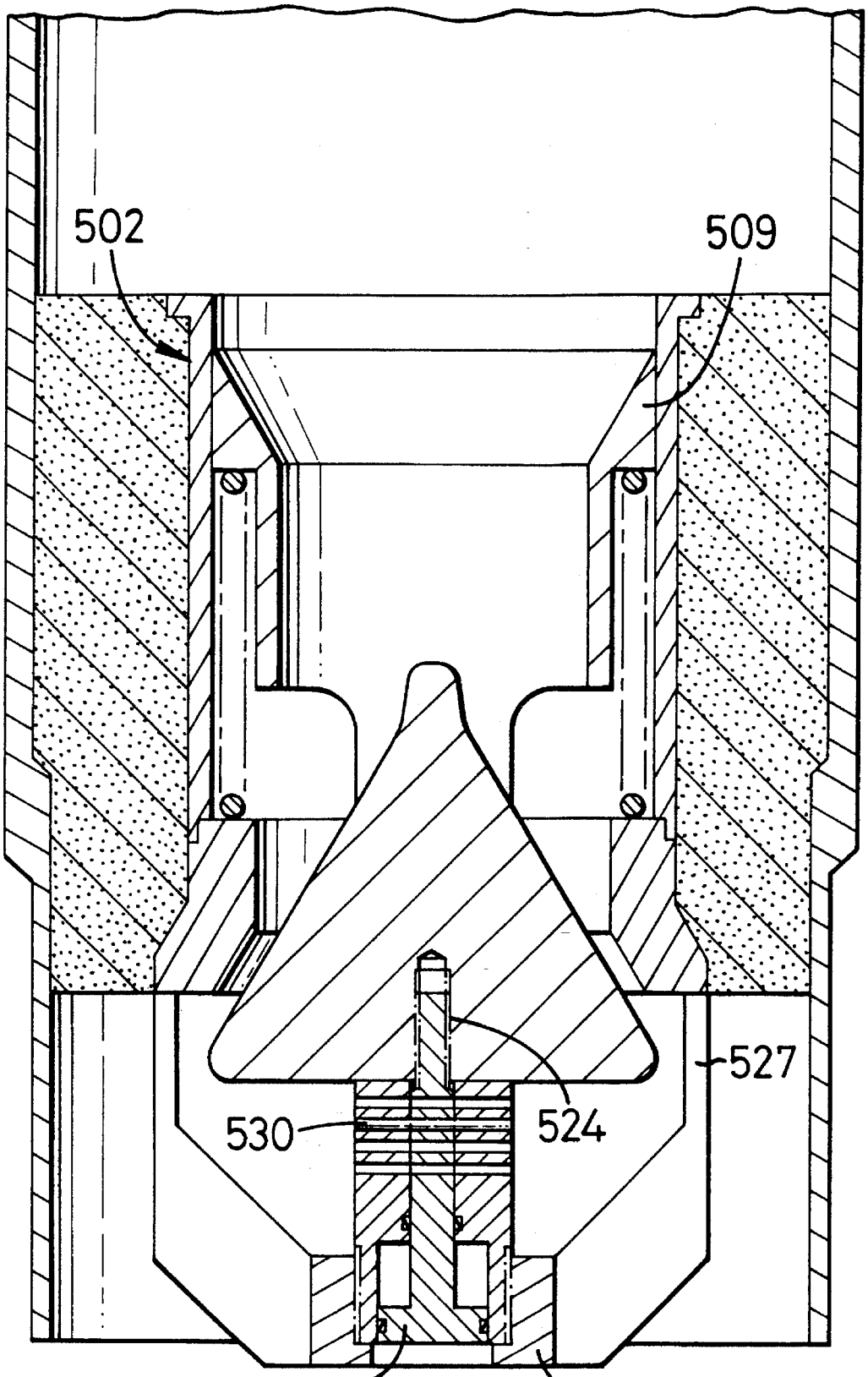
FIG. 11 is a view similar to FIG. 10 showing the fill valve with the attachment in an operative position.

In the embodiment shown in FIG. 10, the head 510 of the valve member 509 is provided with a threaded bore 524 into which is screwed an attachment 525. The attachment 525 comprises a spider having four legs 527 which radiate outwardly from a hub 528.

A bolt 529 extends through the hub 528 and is screwed into the threaded bore 524.

When lowering a string of casing into a wellbore it is sometimes desirable to be able to allow liquid from the wellbore to flow into the casing at a controlled rate. For this purpose a shear pin 530 is first inserted through a bore extending through the hub 528 and the bolt 529. The hub 529 is then rotated so that the bolt 529 enters the threaded bore 524. Rotation is continued until the attachment 525 bears against the valve seat 507 and the fill valve is opened by the desired amount.

In use, the valve member 509 is opened by the desired amount and the casing lowered down the wellbore. When the pressure on the bottom of the head 510 of the valve member 509 reaches a predetermined level the shear pin 530 breaks and the fill valve closes.

During a cementing operation the valve member 509 is displaced downwardly in the previously described manner to allow fluid to pass through the valve 502.

Various modifications to the embodiments described are envisaged. For example, whilst the preferred tubular portion is of circular cross-section it could also be polygonal; for example square, or oval although circular is much preferred. Whilst the head 210 of the valve member 209 shown in FIGS. 6 and 7 uses an O-ring seal 221 this, may be omitted in certain circumstances. Alternatively, the head 210 may comprise a resilient sealing material.

Our most recent work indicates that the deflector should be shaped to inhibit turbulence in the fluid as it passes through the fill valve. This reduces cavitation which, in turn, reduces errosion and enhances the longevity of the fill valve.

What is claimed is:

1. A fill valve for use in cementing operations in the construction of oil and gas wells, which fill valve comprises a tubular housing having a valve seat, a valve member slidably mounted in said tubular housing, and spring means biasing said valve member towards a closed position, wherein said valve member comprises a head engageable with said valve seat of said tubular housing to close the valve, a tubular portion and at least one window in said tubular portion, so that fluid pumped through said tubular portion displaces said valve member relative to said tubular housing to open the fill valve and exit via said at least one window.

2. A fill valve as claimed in claim 1 wherein said tubular portion has at least two windows disposed in the periphery thereof.

3. A fill valve as claimed in claim 1, wherein said valve member is provided with a deflector for deflecting fluid entering said tubular portion towards said at least one window.

4. A fill valve as claimed in claim 3, where said tubular portion is provided with two windows which are disposed opposite one another and said deflector extends from said head into said tubular portion.

5. A fill valve as claimed in claim 1, wherein said head has a bevelled surface which seats on a correspondingly bevelled valve seat on said tubular housing when said valve member is in its closed position.

6. A fill valve as claimed in claim 1,, wherein said spring means comprises a coil spring biasing said valve member against said valve seat.

7. A fill valve as claimed in claim 6, wherein said coil spring is mounted circumjacent the tubular portion of said valve member, said tubular portion is provided with a flange, said tubular housing is provided with a shoulder, and said coil spring acts between said flange and said shoulder.

8. A fill valve as claimed in claim 1, including an attachment connected to said valve member, said attachment being adjustable to maintain said fill valve in a partially open position.

9. A fill valve as claimed in claim 8, wherein said attachment comprises a spider having at least one leg which radiates outwardly from a hub, and a member which extends through said hub and engages said valve member, the arrangement being such that the opening of said fill valve may be adjusted by rotation of said member.

10. A fill valve for use in cementing operations in the construction of oil and gas wells, which fill valve comprises a tubular housing, a valve member slidably mounted in said tubular housing having a valve seat, and spring means biasing said valve member towards a closed position, wherein said valve member comprises a head engageable with said valve seat on said tubular housing to close the valve, a tubular portion and two windows in said tubular portion, so that when said fill valve is open, fluid can flow through said tubular portion and exit via said windows, and so that fluid pumped through said tubular portion displaces said valve member relative to said tubular housing to open the fill valve and exit via said at least one window, wherein said two windows are disposed opposite one another and said valve member is provided with a deflector for deflecting fluid entering said tubular portion towards said windows.

11. A fill valve as claimed in claim 10, where said deflector extends from said head into said tubular portion.

12. A fill valve as claimed in claim 11, wherein said head has a bevelled surface which seats on a correspondingly bevelled valve seat on said tubular housing when said valve member is in its closed position.

13. A fill valve as claimed in claim 10, wherein said spring means comprises a coil spring biasing said valve member against said valve seat.

14. A fill valve as claimed in claim 13, wherein said coil spring is mounted circumjacent the tubular portion of said valve member, said tubular portion is provided with a flange, said tubular housing is provided with a shoulder, and said coil spring acts between said flange and said shoulder.

15. A fill valve as claimed in claim 10, including an attachment connected to said valve member, said attachment being adjustable to maintain said fill valve in a partially open position.

16. A fill valve as claimed in claim 15, wherein said attachment comprises a spider having a plurality of legs which radiate outwardly from a hub, and a member which extends through said hub and engages said valve member, the arrangement being such that the opening of said fill valve may be adjusted by rotation of said member.

* * * * *